US008055183B2

(12) United States Patent
Inenaga

(10) Patent No.: US 8,055,183 B2
(45) Date of Patent: Nov. 8, 2011

(54) IMAGE FORMING APPARATUS

(75) Inventor: Yoriko Inenaga, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 915 days.

(21) Appl. No.: 12/013,610

(22) Filed: Jan. 14, 2008

(65) Prior Publication Data

US 2009/0041482 A1 Feb. 12, 2009

(30) Foreign Application Priority Data

Aug. 7, 2007 (JP) ..... 2007-205152

(51) Int. Cl.
*G03G 15/00* (2006.01)

(52) U.S. Cl. ..... 399/405; 399/397

(58) Field of Classification Search ..... 399/405
See application file for complete search history.

(56) References Cited

U.S. PATENT DOCUMENTS 5,946,541 A * 8/1999 Kakigi ..... 399/405
5,950,045 A * 9/1999 Nomura et al. ..... 399/81
7,263,328 B2 * 8/2007 Asai et al. ..... 399/408
7,341,247 B2 * 3/2008 Hirata et al. ..... 270/58.07
7,810,804 B2 * 10/2010 Mori ..... 271/176
2007/0090586 A1 * 4/2007 Ohnishi et al. ..... 271/9.01
2007/0116486 A1 * 5/2007 Katahira ..... 399/75
2007/0147922 A1 * 6/2007 Iida et al. ..... 399/405

FOREIGN PATENT DOCUMENTS

JP 04-80143 3/1992
JP 5-155511 6/1993
JP 10-291726 11/1998
JP 2004-175513 6/2004

OTHER PUBLICATIONS

Japanese Office Action dated Jun. 9, 2009.

* cited by examiner

*Primary Examiner* — Anthony H. Nguyen
(74) *Attorney, Agent, or Firm* — Finnegan, Henderson, Farabow, Garrett & Dunner, L.L.P.

(57) ABSTRACT

Disclosed is an image forming apparatus which forms an image including an image forming unit to form the image on a paper, a plurality of paper ejection trays to mount the paper on which the image is formed, a display unit to display a setting screen for selecting at least one paper ejection tray for a reserved job among the paper ejection trays, detecting units to detect a present mounting amount of the paper in each paper ejection tray and a control unit to control the display of the setting screen, and the control unit simultaneously displays the detected mounting amount of each paper ejection tray on one setting screen.

11 Claims, 10 Drawing Sheets

IMAGE FORMING APPARATUS

BACKGROUND OF THE INVENTION

1. Field of the Invention

The present invention relates to an image forming apparatus which forms an image on a paper.

2. Description of Related Art

In an image forming apparatus, papers which are ejected after an image is formed are mounted on a paper ejection tray. When the mounting amount reaches the maximum mounting amount of the paper ejection tray, the image forming itself is once stopped in the image forming apparatus or the paper ejection is switched to a different paper ejection tray.

In the case where the image forming itself is stopped once, the operation rate of the image forming apparatus declines while the image forming is stopped. Because the image forming does not restart unless a user takes out the mounted papers from the paper ejection tray, a user has to always check the mounting amount when the image forming is carried out continuously. Further, in case where the paper ejection is switched to a different paper ejection tray, it is cumbersome because a user has to collect the mounted papers from each of the different paper ejection trays.

For the above problems, a method for calculating and displaying the time needed to reach the maximum mounting amount of the paper election tray from the present mounting amount of the paper ejection tray so that a user can easily check the mounting amount of the paper ejection tray is disclosed (for example, see JP2004-175513A). Further, there is an image forming apparatus in which the ejection amount for one job is calculated in the image forming apparatus and the paper ejection tray which can house all the calculated amount of ejected paper is determined and output so that the papers of one job are to be ejected to the same paper ejection tray (for example, see JP5-155511A).

However, in the method of above described JP2004-175513A, the mounting amount of only one of the paper ejection trays is displayed and only the time needed for the paper ejection tray to reach the maximum mounting amount after the execution of the actual image forming is started can be known. In such way, the over all mounting status cannot be known when there are a plurality of paper ejection trays, and a user cannot select the appropriate paper ejection tray when a user herself/himself is selecting the paper ejection tray.

Moreover, in the method according to JP5-155511A, a user cannot confirm to which paper ejection tray the papers are to be ejected before the image forming because the image forming apparatus automatically assigns where the papers are to be ejected.

Further, a user herself/himself cannot select the paper ejection tray to which she/he desires the papers to be ejected.

SUMMARY OF THE INVENTION

An object of the present invention is to allow a user to easily select an appropriate paper ejection tray.

To achieve the above object, according to a first aspect of the present invention an image forming apparatus which forms an image comprises an image forming unit to form the image on a paper, a plurality of paper ejection trays to mount the paper on which the image is formed, a display unit to display a setting screen for selecting at least one paper ejection tray for a reserved job among the paper ejection trays, detecting units to detect a present mounting amount of the paper in each paper ejection tray, and a control unit to control the display of the setting screen, and the control unit simultaneously displays the detected mounting amount of each paper ejection tray on one setting screen.

According to the present invention, a user can know the present mounting status of each paper ejection tray at once, and a user can easily select an appropriate paper ejection tray to which the papers of the reserved job are to be mounted.

BRIEF DESCRIPTION OF THE DRAWINGS

The present invention will become more fully understood from the detailed description given hereinbelow and the appended drawings, and thus are not intended as a definition of the limits of the present invention, and wherein.

DESCRIPTION OF THE PREFERRED EMBODIMENTS

Hereinafter, the embodiments according to the image forming apparatus of the present invention will be described with reference to the drawings.

Figure 1:
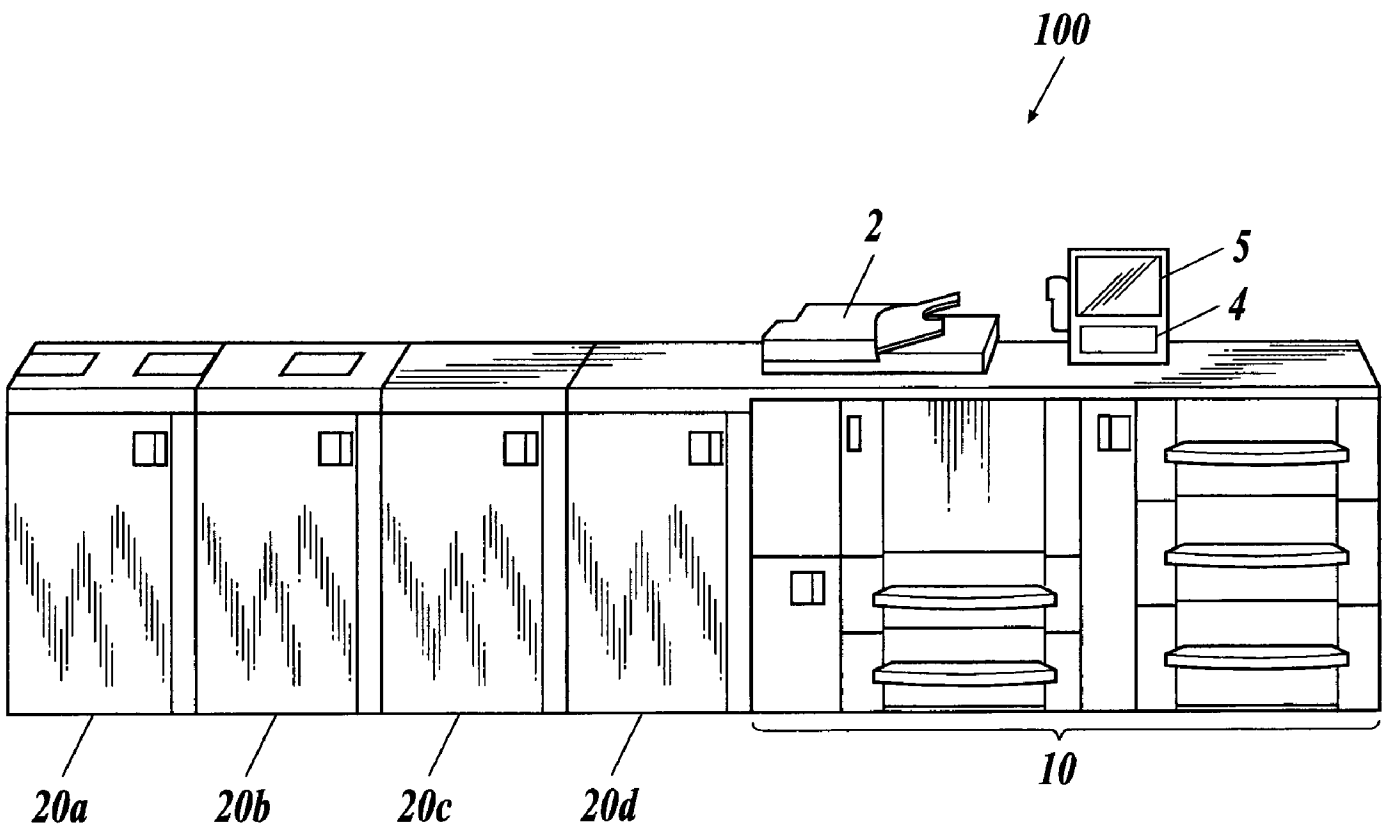
FIG. 1 is a diagram showing an image forming apparatus according to the embodiment.

FIG. 1 shows an image forming apparatus 100 according to the embodiment.

As shown in FIG. 1, the image forming apparatus 100 comprises a main body 10 for carrying out the image forming, a plurality of stackers 20*a* to 20*d* for mounting the ejected papers on which the image is formed and the like. An image reading unit 2, an operation unit 4, a display unit 5 and the like are provided at the main body 10.

Figure 2:
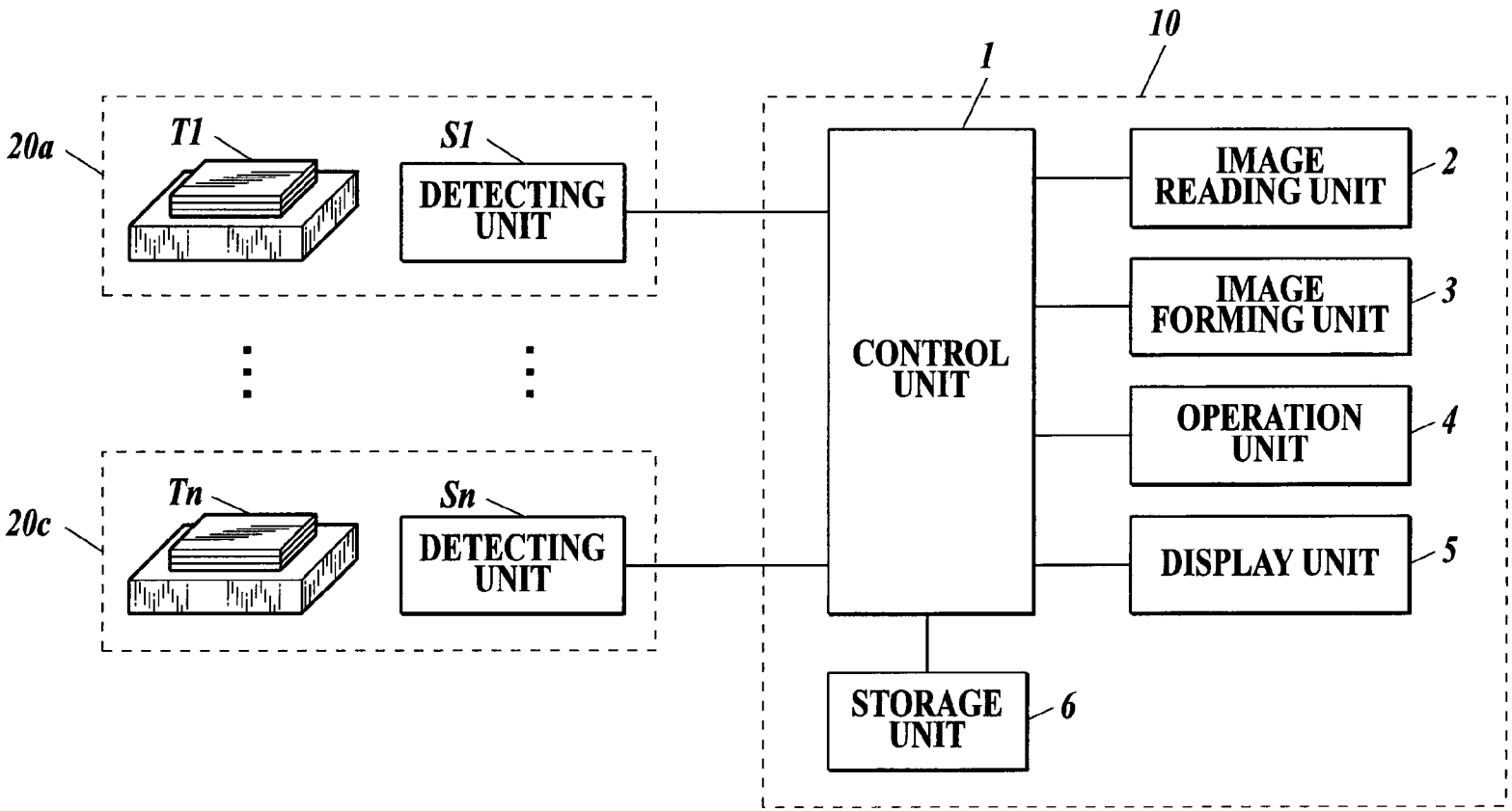
FIG. 2 is a diagram showing a functional structure of the image forming apparatus of FIG. 1.

FIG. 2 shows the functional structure of the image forming apparatus 100.

As shown in FIG. 2, the main body 10 comprises a control unit 1, the image reading unit 2, an image forming unit 3, the operation unit 4, the display unit 5, a storage unit 6 and the like.

The control unit 1 comprises the CPU (Central Processing Unit), the RAM (Random Access Memory) and the like, and carries out various types of calculations in cooperation with the control program stored in the storage unit 6 to control the operation of each unit. For example, the control unit 1 controls the input/output of the image data to/from each unit in a series of image forming process, and carries out display control or the like of the operation screen.

The image reading unit 2 comprises the ADF (Auto Document Feeder), a scanner and the like, and reads the image of the document and carries out the process of generating the data of the image. The data of the image generated by the reading process is stored in the storage unit 6.

The image forming unit 3 forms the image on a paper based on the data of the image input by the control unit 1. The image forming method of the image forming unit 3 may be any method. The case of electro photography method will be described here as an example. In the case of electro photography method, the image forming unit 3 comprises a paper feeding unit, an exposure unit, a transfer belt, a developing unit, a fixing unit and the like, and carries out the exposure by emitting the laser beam to the photosensitive drum from the laser beam source of the exposure unit and forms an electrostatic latent image. Then, the image forming unit 3 forms a toner image by developing the electrostatic latent image on the photosensitive drum by the toner of the developing unit, and carries out the image forming by transferring the toner image on the paper which is carried from the paper feeding unit.

The operation unit 4 comprises a touch panel or the like which is constructed integrally with operation keys and the display unit 5, and generates an operation signal corresponding to the operations and outputs the operation signal to the control unit 1.

The display unit 5 comprises a display, and displays the setting screen showing the image forming conditions regarding the reserved job and the screen for various types of operations such as a setting screen to select the paper ejection tray and the like according to the display control of the control unit 1.

The storage unit 6 comprises a large capacity memory. The storage unit 6 stores the control program, the parameters and the like. For example, the storage unit 6 stores the information of the maximum mounting amount which can be mounted on each paper ejection tray Tn of the stackers 20*a* to 20*d* as the initial setting information.

Moreover, the storage unit 6 stores the data of the image to be formed such as the data of the image read by the image reading unit 2 and the like.

As shown in FIG. 2, each of the stackers 20*a* to 20*d* comprises the paper ejection tray Tn. A detecting unit Sn which correspond to each paper ejection tray Tn (n indicates the identification number of each paper ejection tray, n=1, 2 . . . followed in a same manner.) is respectively provided at each paper ejection tray Tn.

The paper ejection tray Tn is structured so as to move in an up/down direction in the stackers 20*a* to 20*d*. When papers are not mounted, the paper ejection tray Tn is positioned at the upper limit position of the moving range, and gradually moves downward by being driven by the driving unit (omitted from the drawing) as the papers are mounted on the paper ejection tray Tn. When the maximum amount of papers are mounted on the paper ejection tray Tn, the paper ejection tray Tn reaches the lower limit of the moving range.

The detecting unit Sn detects the present mounting amount of the papers in the paper ejection tray Tn, and outputs the detecting result to the control unit 1.

The detecting unit Sn comprises an upper limit sensor and a lower limit sensor to detect that the paper ejection tray Tn is positioning at the upper limit and the lower limit of the moving range, a moving position sensor to detect the moving position of the paper ejection tray Tn and the like. The upper limit sensor and the lower limit sensor are light sensors or the like, and the moving position sensor is a rotary encoder or the like. The moving position sensor outputs the moving distance of the paper ejection tray Tn by counting the moving distance by the pulse number after the position of the paper ejection tray Tn is detected by the upper limit sensor. Therefore, the output of the moving position sensor can be obtained as the present mounting amount by setting the output of the upper limit sensor to 0 and setting the output of the lower limit sensor to the maximum mounting amount, and by changing the value of the output of the moving position sensor to the value between 0 and the maximum mounting amount.

Particularly, the control unit 1 calculates the moving distance of the paper ejection tray Tn from the upper limit position to the moving position based on the output value of each sensor of the detecting unit Sn, and obtains the moving ratio by dividing the calculated moving distance by the total moving distance from the upper limit position to the lower limit position. Then, the control unit 1 calculates the product of the moving ratio and the maximum mounting amount as the present mounting amount.

Here, the present mounting amount can be obtained in the relative value with respect to the maximum mounting amount when the outputs of the sensors are converted in the range of 0 and 100.

Next, the operation of the above described image forming apparatus 100 will be described.

Figure 3:
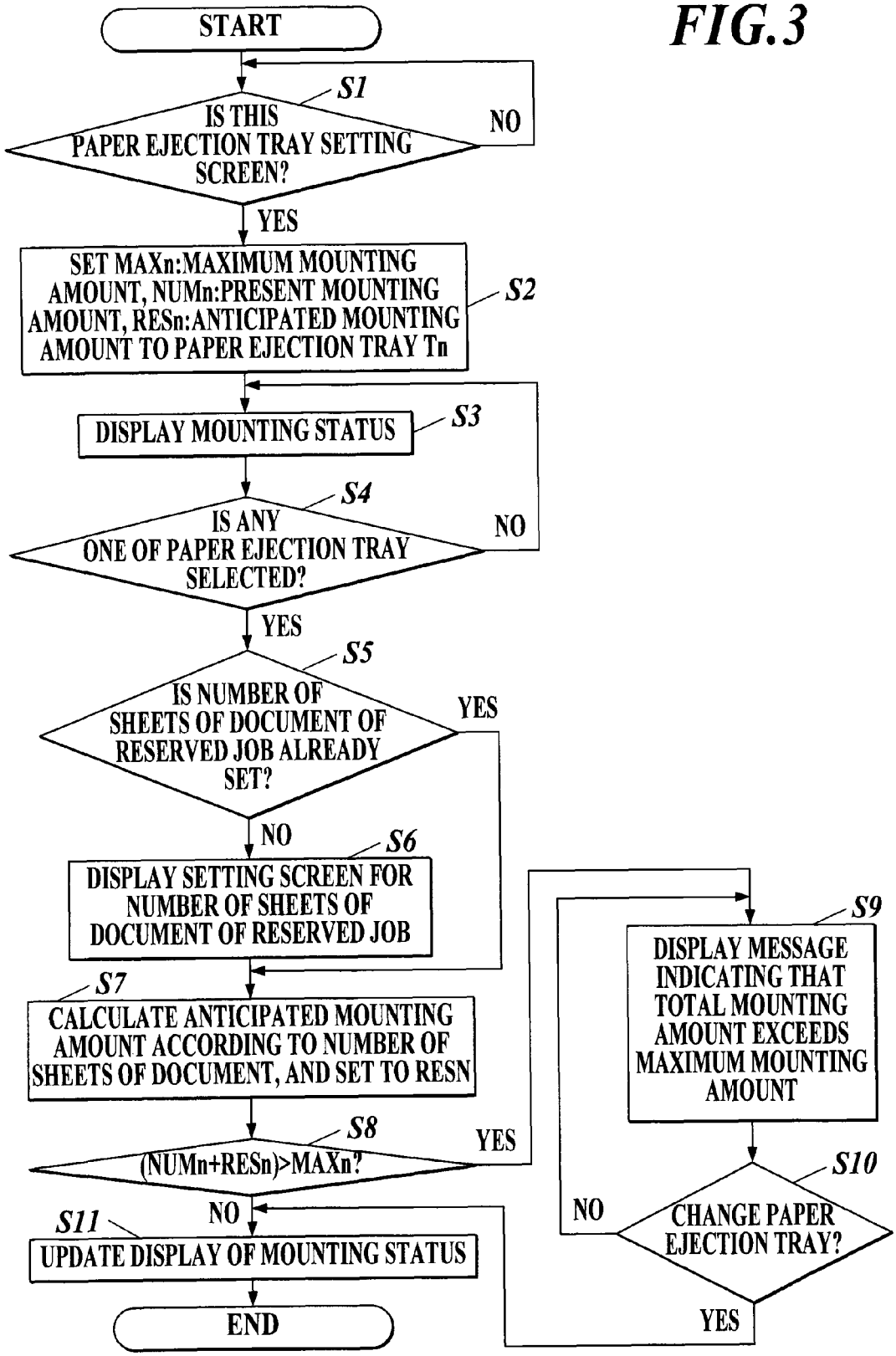
FIG. 3 is a flowchart showing a process flow which is carried out by the image forming apparatus.

FIG. 3 is a flowchart for explaining the flow of the process which is carried out by the image forming apparatus 100. This process is a process which is carried out when the paper ejection tray in which the papers that has the image formed by the reserved job to be ejected is set as one of the setting of the reserved job.

When the setting of the image forming condition regarding the reserved job is finished and subsequently, when the setting screen of the paper ejection tray is displayed (step S1; Y), the control unit 1 obtains the detecting result of the present mounting amount of the papers in each paper ejection tray Tn from the detecting unit Sn which corresponds to each paper ejection tray Tn. As for the each paper ejection tray Tn, each has parameters which are the MAXn which indicates the maximum mounting amount, the NUMn which indicates the present mounting amount and the RESn which indicates the anticipated mounting amount. Therefore, the control unit 1 sets the value of the present mounting amount which is detected by the detecting unit Sn to the NUMn. Here, the value which is stored in the storage unit 6 will be set because the maximum mounting amount is determined beforehand. Further, when there is a reserved job in which the setting is already done, the anticipated mounting amount which is anticipated to be mounted by the execution of the reserved job can be calculated. Therefore, the value of the anticipated mounting amount is set to the RESn (step S2).

Next, the control unit 1 displays the present mounting status of each paper ejection tray Tn on the setting screen based on the value of the MAXn, the NUMn and the RESn which are set for each paper ejection tray Tn (step S3). Particularly, the control unit 1 displays the present mounting amount of each paper ejection tray Tn simultaneously on one setting screen so that the overall present status of each paper ejection tray Tn can be known.

Figure 4:
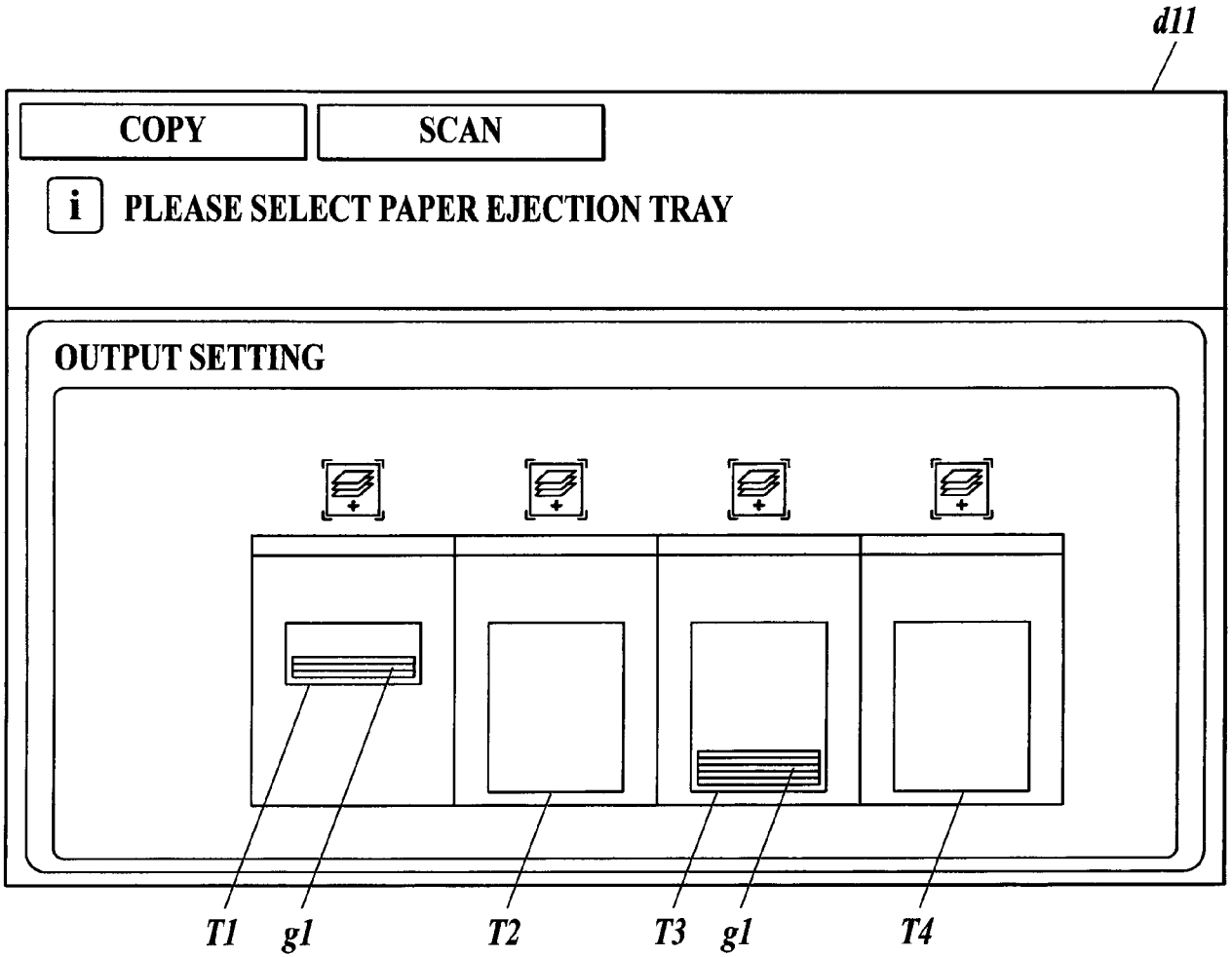
FIG. 4 is a diagram showing an example of a setting screen for selecting a paper ejection tray.

For example, when there is no reserved job in which the setting is already done, the control unit 1 displays the setting screen d11 as shown in FIG. 4. In the setting screen d11, the control unit 1 expresses the maximum mounting amount and the present mounting amount in each paper ejection tray Tn (n=1 to 4) by images. That is, an image indicating the housing region of papers in the paper ejection tray Tn and an image g1 of the papers which are mounted in the housing region are displayed, and the area of each image is an area corresponding to the number of papers of the maximum mounting amount and the number of papers of the present mounting amount. In such way, a user can easily and visually know in what ratio the papers are mounted in which paper ejection tray Tn at the moment.

Figure 5:
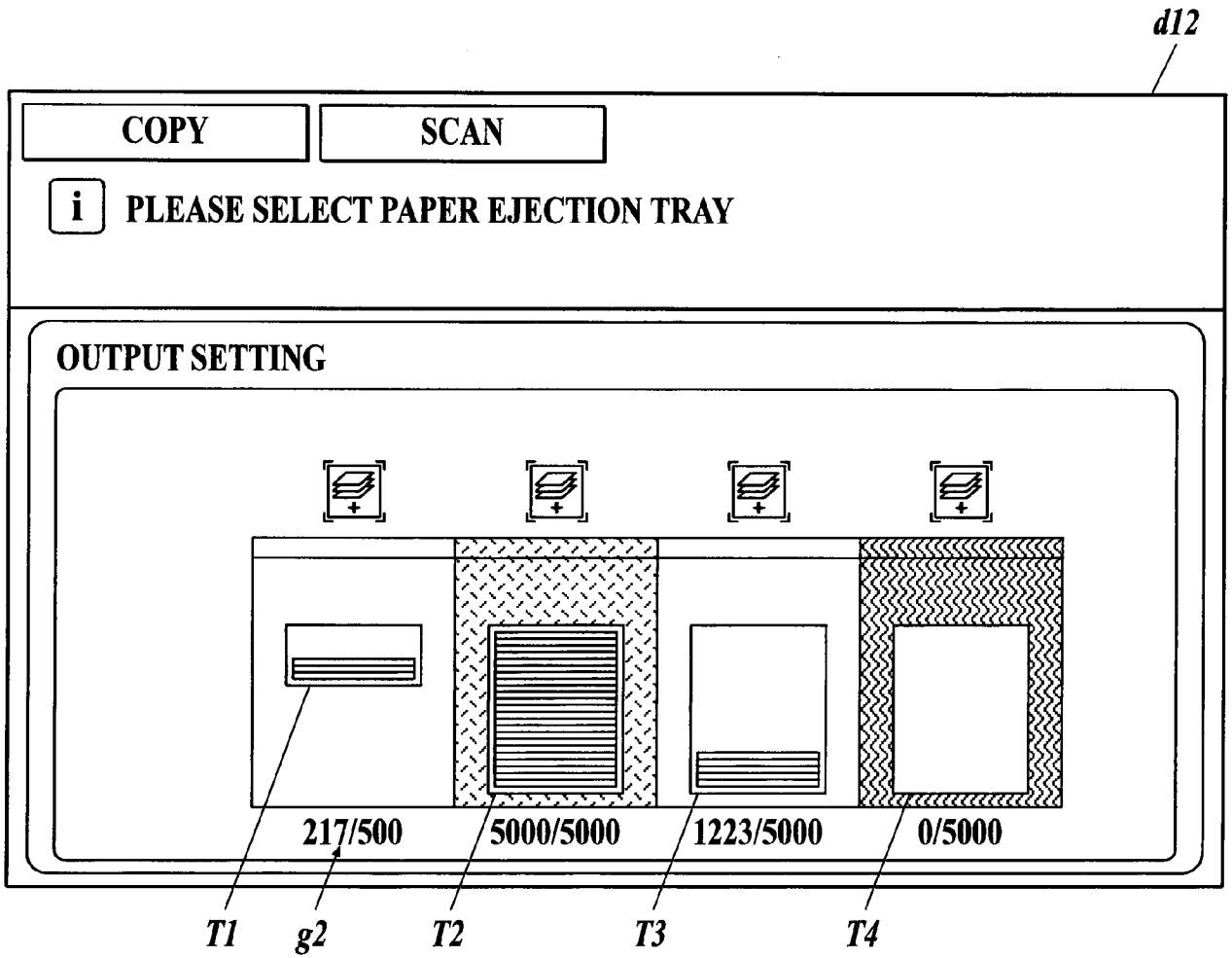
FIG. 5 is a diagram showing an example of a setting screen for selecting a paper ejection tray.

Here, as in the setting screen d12 shown in FIG. 5, the relative value indicating the present mounting amount with respect to the maximum mounting amount may be displayed in a form of fraction for each paper ejection tray Tn. In the example shown in FIG. 5, the relative value is expressed by the number of sheets of the document. For example, the relative value g2 of "217/500" is displayed for the paper ejection tray T1 which indicates that the maximum mounting amount is "500" sheets and the present mounting amount is "217" sheets. In such way, by displaying a particular value, a user can know the mounting status more precisely. Here, the relative value may be expressed in a form using % indication or decimal point and not in the form of fraction.

Moreover, regarding the paper ejection tray Tn in which the present mounting amount is 0 as shown in FIG. 5, that is regarding the paper ejection tray Tn which does not have any paper mounted or regarding the paper ejection tray Tn in which the present mounting amount is the maximum mounting amount, these statuses may be indicated by different display modes such as in a different color, pattern or the like from other paper ejection tray Tn. In the setting screen d12 shown in FIG. 5, an example where the paper ejection tray T4 in which the present mounting amount is 0 is displayed in blue and the paper ejection tray T2 in which the present mounting amount is at the maximum mounting amount 5000 is displayed in red is shown. When the selecting of the paper ejection tray Tn is carried out by a user, the paper ejection tray Tn in which the present mounting amount is the smallest is preferred to be targeted for the selection, and in contrary, the paper ejection tray Tn in which the present mounting amount is at the maximum is not the target for selection. Therefore, the paper ejection tray Tn can be selected easily by allowing the paper ejection tray Tn be easily identified.

Figure 6:
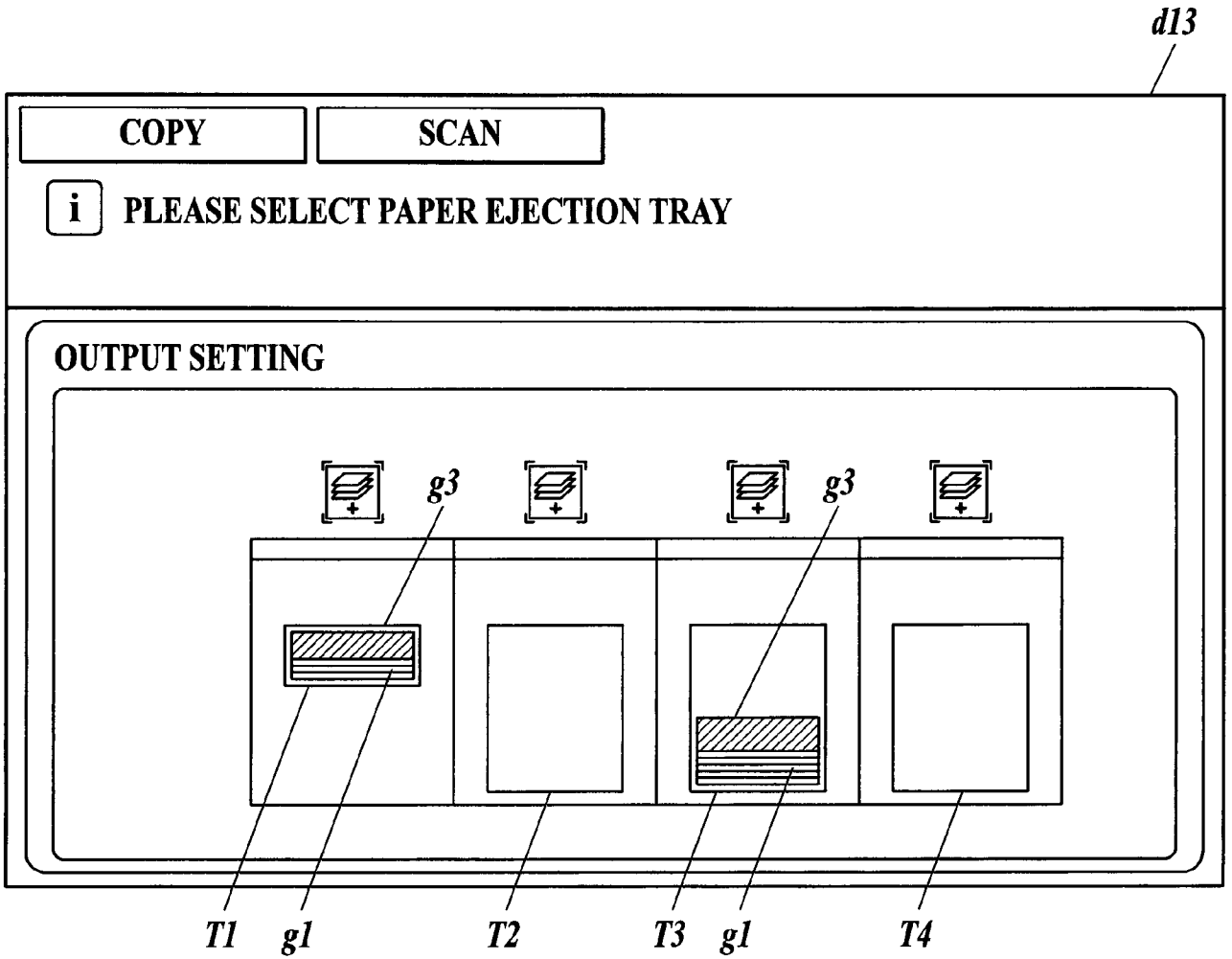
FIG. 6 is a diagram showing an example of a setting screen for selecting a paper ejection tray.

Moreover, when there is a reserved job in which the setting is already done, the control unit 1 displays the setting screen d13 as shown in FIG. 6. In the setting screen d13, the control unit 1 displays the anticipated mounting amount of the reserved job along with the present mounting amount of each paper ejection tray Tn. As for the reserved job in which the setting is already done, the paper ejection tray Tn is also already selected. Therefore, the image g3 of the papers indicating the anticipated mounting amount is displayed by being added to the image g1 of the papers indication the present mounting amount of the selected paper ejection tray Tn. Here, the display modes are made to be different such that the image g3 of the paper indicating the anticipated mounting amount is displayed in a different color from the color used for the display of the present mounting amount. The papers which are already mounted and the papers which are planned to be mounted can be easily discriminated by displaying the images in different display modes.

Figure 7:
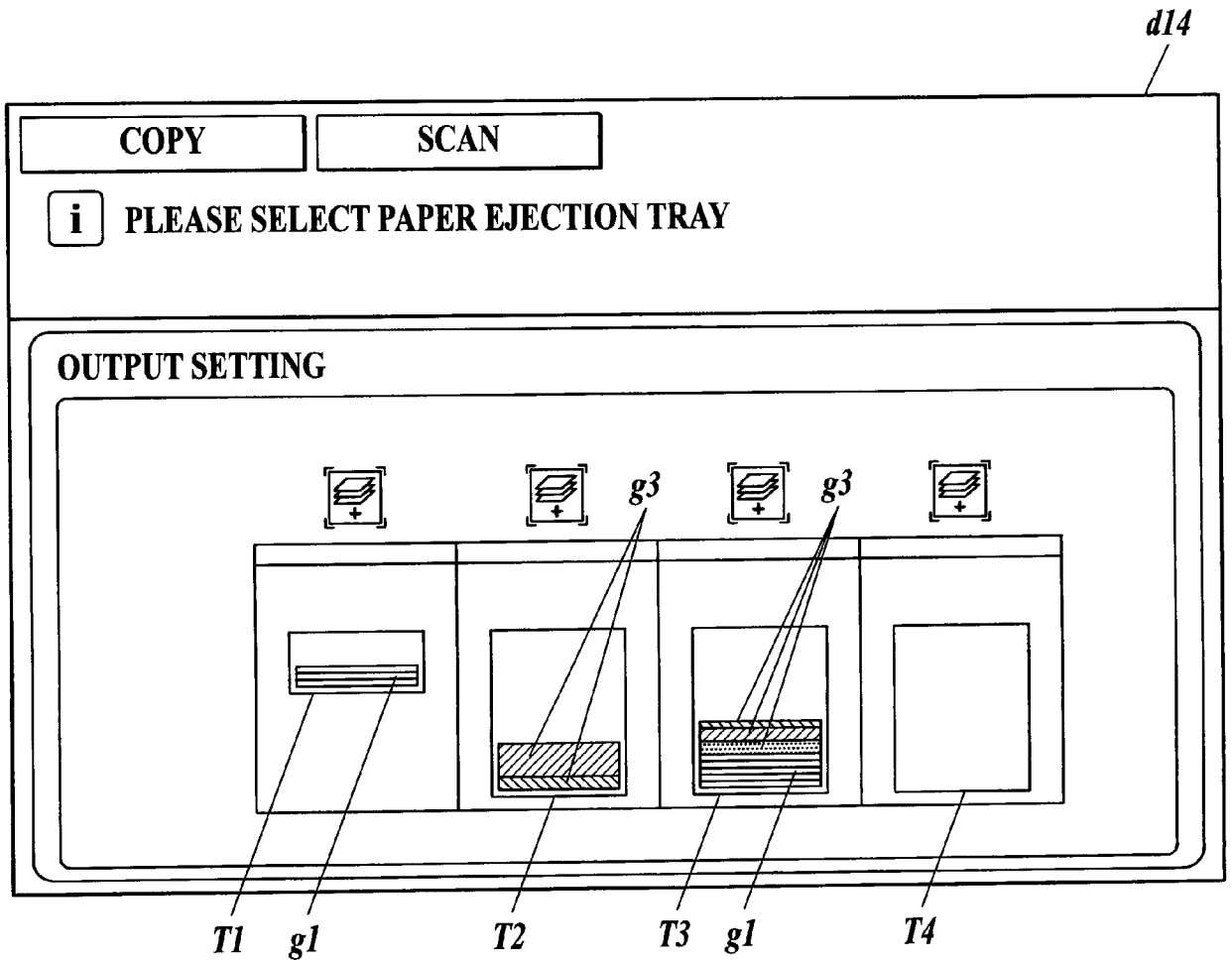
FIG. 7 is a diagram showing an example of a setting screen for selecting a paper ejection tray.

When there are a plurality of reserved jobs in which the setting is already done, the display mode of the image g3 of the papers indicating the anticipated mounting amount for each reserved job can be displayed indifferent mode as in the setting screen d14 shown in FIG. 7. The papers which are anticipated to be mounted can be discriminated for each reserved job.

By looking at the mounting status displayed on the above described setting screens d11 to d14, a user determines to which paper ejection tray Tn the papers on which the image is formed by the execution of the to-be-set reserved job are to be ejected. Then, a user selects either one of the paper ejection tray Tn in the setting screens d11 to d14 by inputting in the operation unit 4.

Figure 8:
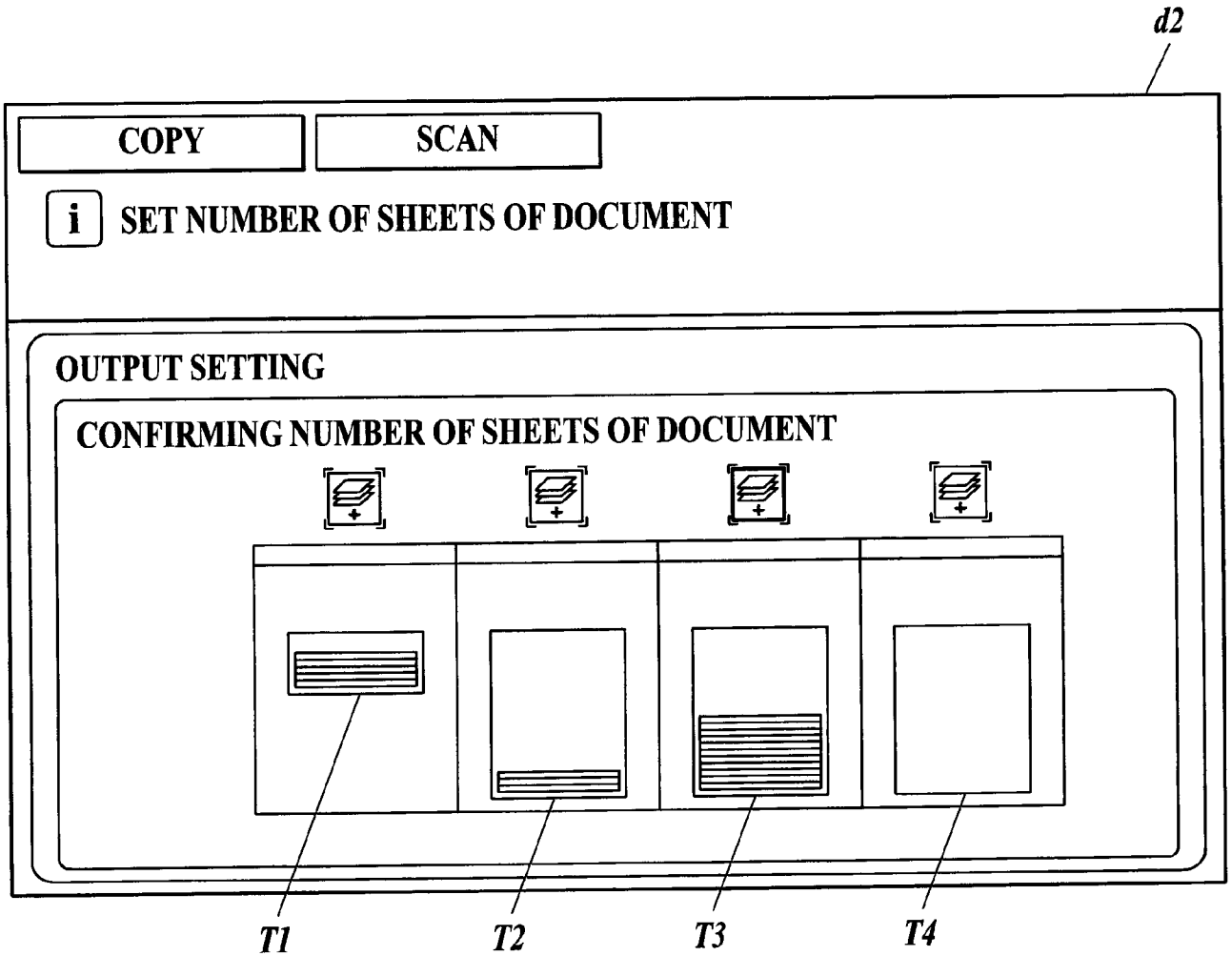
FIG. 8 is a diagram showing an example of a setting screen for setting the number of documents of a reserved job.

When the selecting of either one of the paper ejection tray Tn is input via the operation unit 4 (step S4; Y), the control unit 1 determines whether the number of sheets of document of the reserved job is already set or not (step S5) When the number of sheets of document is already set (step S5; Y), the process proceeds to step S7. On the other hand, when the number of sheets of document is not yet set (step S5; N), the control unit 1 displays the setting screen for setting the number of sheets of document of the reserved job on the display unit 5, and displays a message indicating to set the document on the image reading unit 2 in the setting screen on the display unit 5 (step S6). Then, when the control unit 1 detects that the document is set in the image reading unit 2, the image reading unit 2 starts the reading process of the image of the document. At the time of reading, the control unit 1 displays a message indicating that the number of documents is being confirmed in the setting screen d12 as shown in FIG. 8.

Next, the control unit 1 calculates the anticipated mounting amount of the reserved job from the number of sheets of document which are read by the image reading unit 2, and the calculated mounting amount is set to the RESn of the selected paper ejection tray Tn (step S7). That is, the control unit 1 counts the number of sheets of document which are read by the image reading unit 2, and sets the value which is the number of sheets of document to the RESn as the anticipated mounting amount.

Here, a user may input the number of sheets of document via the operation unit 4 in the setting screen d12, and the value which is the input number of sheets of document may be set to the RESn as the anticipated mounting amount.

The anticipated mounting amount which is calculated here will be used as the anticipated mounting amount of the reserved job in which the setting is already done in the process of step S2 when the next reserved job is set.

Next, the control unit 1 determines whether (NUM+RESn) >MAXn is true or not, that is whether the total mounting amount of the present mounting amount and the anticipated mounting amount exceeds the maximum mounting amount of the selected paper ejection tray Tn or not (step S8).

Figure 9:
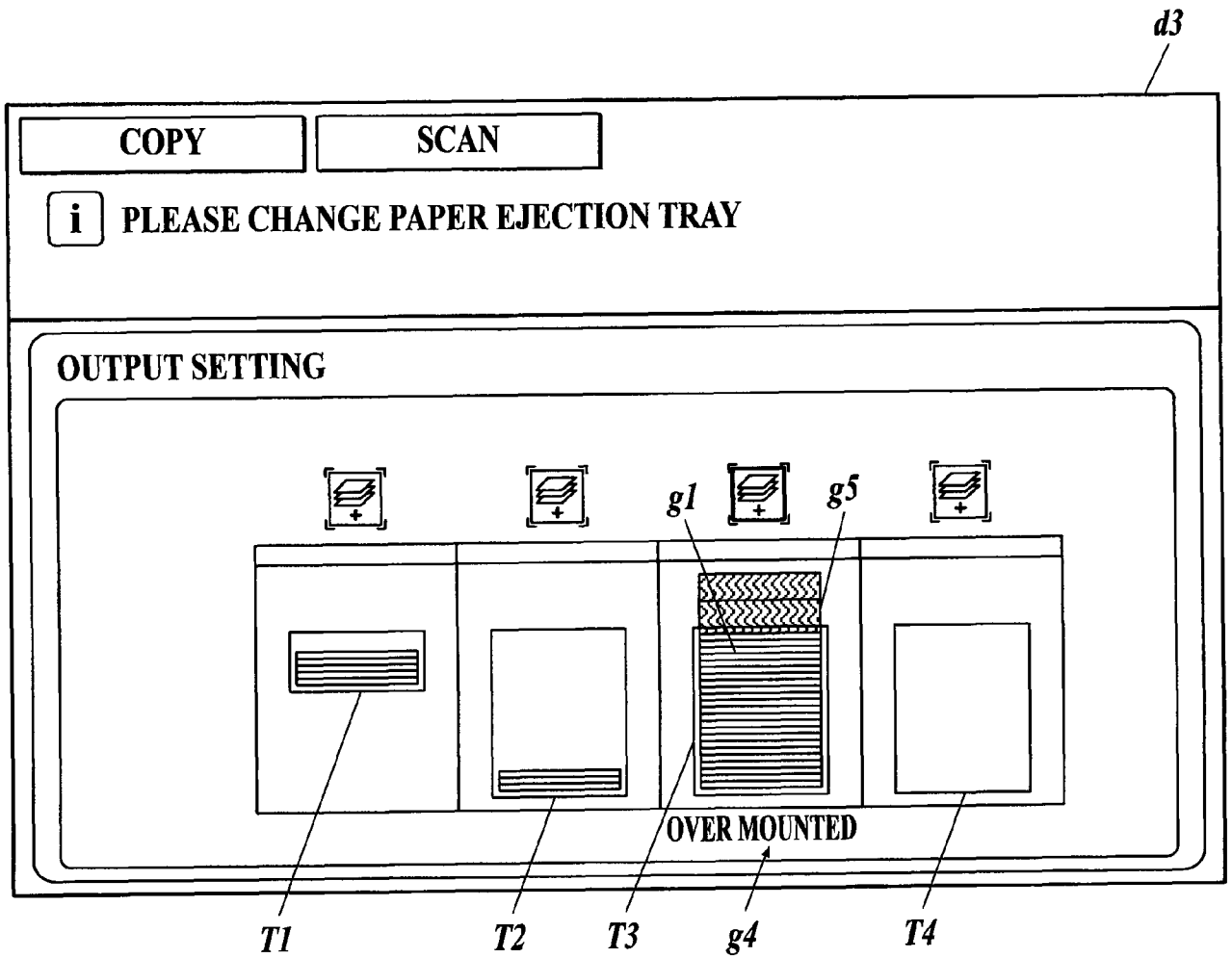
FIG. 9 is a diagram showing an example of a display regarding the exceeding of the maximum mounting amount.

When the total mounting amount exceeds the maximum mounting amount, the control unit 1 makes the display unit 5 to display a notice indicating that the total mounting amount exceeds the maximum mounting amount in the selected paper ejection tray Tn (step S9). For example, the control unit 1 makes the display unit 5 to display the setting screen d3 shown in FIG. 9 and to display the message g4 of "over mounting" which notifies that the total mounting amount exceeds the maximum mounting amount in the setting screen d3. Alternatively, a message indicating that the total mounting amount exceeds the maximum mounting amount is expressed by an image by displaying the image g5 showing the papers exceeding the housing area of the paper ejection tray Tn as shown in FIG. 9.

In the setting screen d3, the selection of the paper ejection tray Tn can be changed. Unless the changing operation of the paper ejection tray Tn is carried out by a user (step S10; N), the control unit 1 cancels other operation and returns to step S9 to continue to display the message indicating that the total mounting amount exceeds the maximum mounting amount.

Figure 10:
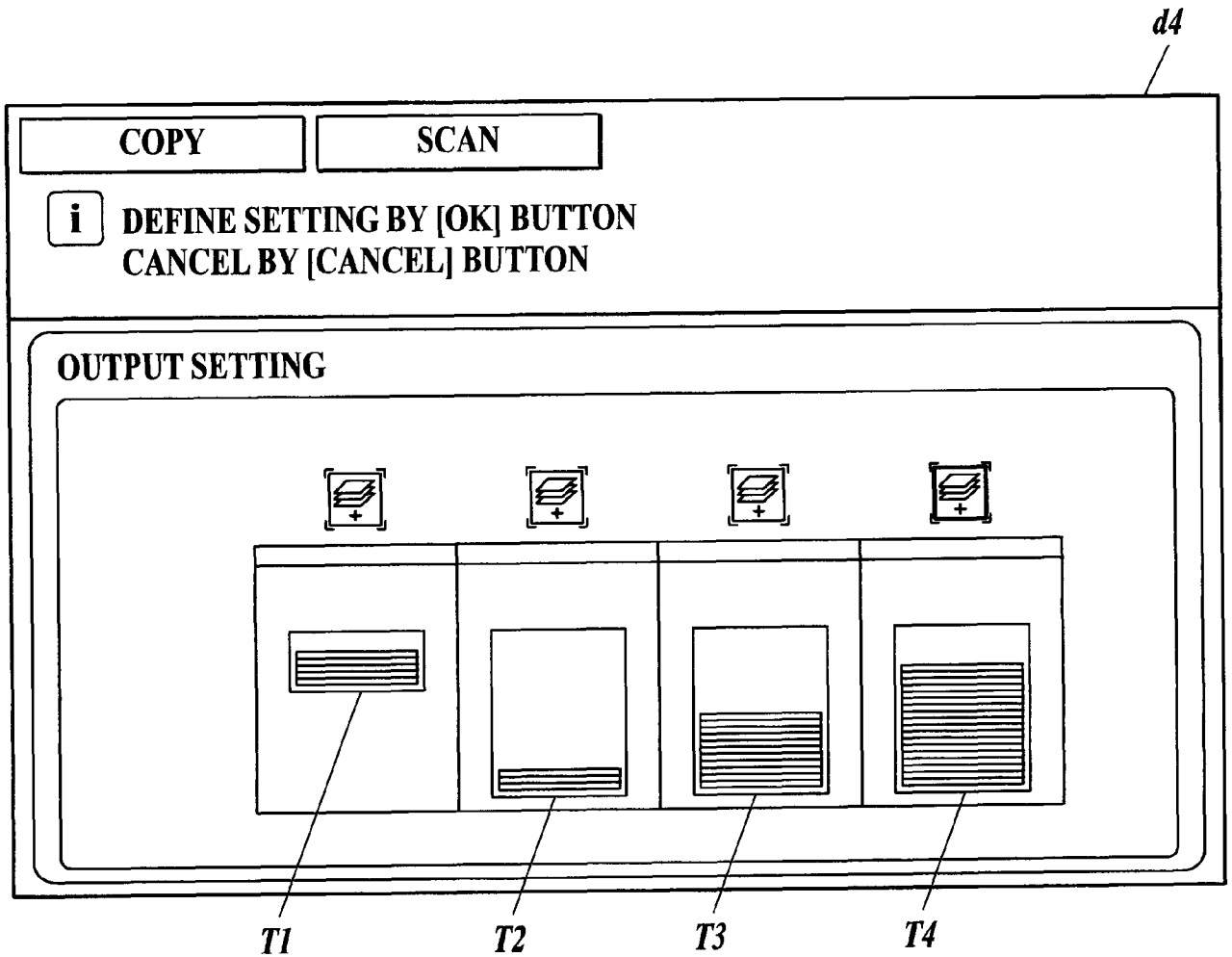
FIG. 10 is a diagram showing an example of a setting screen for reselecting the paper ejection tray.

When the changing operation of the paper ejection tray Tn is carried out by a user (step S10; Y), the control unit 1 hides the display of the message indicating that the total mounting amount exceeds the maximum mounting amount. Then, the setting is changed so as to set the value of the RESn of the paper ejection tray Tn before the change to the changed RESn of the paper ejection tray Tn, and the display of the mounting status is updated based on the value of the changed MAXn, NUMn and RESn (step S11). FIG. 10 is an example of the setting screen d4 after the update is displayed.

Here, when there is a change in the present mounting amount and the anticipated mounting amount due to the finishing of the execution of the reserved job, the setting of the new reserved job or the like while the setting screen d11 to d14 are displayed, the control unit 1 changes the setting of the value of MAXn, NUMn and RESn according to the changed mounting amount. Then, the control unit 1 updates the display of the mounting status of each paper ejection tray Tn based on the value of the changed MAXn, NUMn and RESn.

As described above, according to the embodiment, the present mounting amount for each of the plurality of paper ejection trays Tn is detected, and the detected mounting amounts are simultaneously displayed on the setting screen for selecting the paper ejection tray Tn. In such way, the present mounting status of each paper ejection tray Tn can be easily known when a user selects the paper ejection tray Tn. Therefore, the appropriate paper ejection tray Tn in which the papers of the reserved job are to be mounted can be selected.

Further, the anticipated mounting amount which is anticipated to be mounted by the execution of the reserved job is calculated, and the anticipated mounting amount is displayed along with the present mounting amount of the selected paper ejection tray Tn. Therefore, a user can select the paper ejection tray Tn while predicting the amount of the papers to be ejected.

The anticipated mounting amount is calculated from the number of sheets of document which is counted in the reading process of the image reading unit 2. Therefore, it is efficient because the anticipated mounting amount can be calculated at the same time as the reading process.

Moreover, in the setting screen, the present mounting amount and the anticipated mounting amount are indicated by images which show the papers mounted on each paper ejection tray Tn. Therefore, a user can easily and visually know the mounting status. Further, when the present mounting amount and the anticipated mounting amount are expressed in the relative value with respect to the maximum mounting amount, the particular mounting status will be more easily recognized.

Furthermore, by displaying the anticipated mounting amount in a different display mode from the present mounting amount, the two mounting amounts can be easily discriminated. When there is a plurality of reserved jobs, the anticipated mounting amount for each reserved job can be easily discriminated because the anticipated mounting amount of each reserved job is displayed in different display modes.

When the total mounting amount of the present mounting amount and the anticipated mounting amount exceeds the maximum mounting amount of the selected paper ejection tray Tn, a message or an image which indicate that the total mounting amount exceeds the maximum mounting amount is displayed. Therefore, a user can easily know that the paper ejection tray Tn which is selected by a user cannot mount all the papers which are to be ejected by the reserved job.

When the mounting status changes due to execution of the reserved job and setting of a new reserved job, or taking out of the mounted paper from the paper ejection tray Tn or the like, the present mounting amount and the anticipated mounting amount after the change are detected, calculated and the like, and are updated and displayed. In such way, a user can always know the updated mounting status.

The above described embodiment is a preferred example in which the present invention is applied, and the application is not limited to this.

For example, when the image forming apparatus is structured so that the papers of one reserved job can be dispersedly ejected to a plurality of paper ejection trays, a plurality of paper ejection trays Tn may be selected in the setting screens d11 to d14. In such case, the structure in which the present mounting amount of each paper ejection tray Tn is displayed simultaneously so that the present mounting amount of each paper ejection tray Tn can be known at once is more effective for selecting a plurality of paper ejection trays Tn.

According to a first aspect of the present invention, an image forming apparatus which forms an image comprises an image forming unit to form the image on a paper, a plurality of paper ejection trays to mount the paper on which the image is formed, a display unit to display a setting screen for selecting at least one paper ejection tray for a reserved job among the paper ejection trays, detecting units to detect a present mounting amount of the paper in each paper ejection tray and a control unit to control the display of the setting screen, and the control unit simultaneously displays the detected mounting amount of each paper ejection tray on one setting screen.

According to the image forming apparatus, the present mounting status of each paper ejection tray can be known at once, and the appropriate paper ejection tray in which the papers of the reserved job are to be mounted can be easily selected.

Preferably, the control unit calculates an anticipated mounting amount of the paper to be mounted by executing the reserved job and displays the calculated anticipated mounting amount on the display unit along with the present mounting amount of each paper ejection tray.

Preferably, the image forming apparatus further comprises an image reading unit to read a document of the reserved job, and the control unit calculates the anticipated mounting amount based on the number of sheets of the document read by the image reading unit.

Preferably, the image forming apparatus further comprises an operation unit, and the control unit calculates the anticipated mounting amount based on the number of sheets of the document when the number of sheets the document of the reserved job is input via the operation unit.

According to the image forming apparatus, a user can select the paper ejection tray by predicting the amount of papers which are to be ejected by the reserved job and not only by predicting the present mounting amount.

Preferably, the control unit expresses the present mounting amount or the anticipated mounting amount in a relative value with respect to maximum mounting amount of each paper ejection tray.

According to the image forming apparatus, a user can know the mounting status in particular value.

Preferably, the control unit expresses the present mounting amount or the anticipated mounting amount by an image in which the paper is mounted on each paper ejection tray.

According to the image forming apparatus, a user can know the mounting status visually, and the paper ejection tray can be selected easily.

Preferably, the control unit displays the anticipated mounting amount in a display mode which is different from the present mounting amount.

According to the image forming apparatus, the anticipated mounting amount and the present mounting amount can be discriminated easily.

Preferably, when there are a plurality of reserved jobs, the control unit displays the anticipated mounting amount of each reserved job in different display modes.

According to the image forming apparatus, the anticipated mounting amount and the present mounting amount can be easily discriminated for each reserved job.

Preferably, the image forming apparatus further comprises an operation unit, and when one paper ejection tray is selected among the plurality of paper ejection trays via the operation unit, the control unit determines whether a total mounting amount of the present mounting amount and the anticipated mounting amount of the selected paper ejection tray exceeds maximum mounting amount of the paper ejection tray or not, and the control unit displays a message indicating that the total mounting amount exceeds the maximum mounting amount on the display unit when the total mounting amount exceeds the maximum mounting amount.

Preferably, the control unit displays a message indicating that the total mounting amount exceeds the maximum mounting amount of the paper ejection tray.

Preferably, the control unit displays an image indicating that the total mounting amount exceeds the maximum mounting amount of the paper ejection tray.

Preferably, the control unit continues to display the message indicating that the total mounting amount exceeds the maximum mounting amount until the paper ejection tray is changed to another paper ejection tray via the operation unit.

According to the image forming apparatus, it can be known that the selected paper ejection tray cannot mount all the papers to be ejected by the reserved job in advance.

Preferably, when the present mounting amount or the anticipated mounting amount is changed, the control unit updates and displays the present mounting amount or the anticipated mounting amount on the setting screen according to the changed present mounting amount or the changed anticipated mounting amount.

According to the image forming apparatus, a user can always know the updated mounting status.

The present U.S. patent application claims a priority under the Paris Convention of Japanese paten application No. 2007-205152 filed on Aug. 7, 2007, which shall be a basis of correction of an incorrect translation.

What is claimed is:

1. An image forming apparatus which forms an image, comprising:

an image forming unit to form the image on a paper;

a plurality of paper ejection trays to mount the paper on which the image is formed;

a display unit to display a setting screen for selecting at least one paper ejection tray for a reserved job among the paper ejection trays;

detecting units to detect a present mounting amount of the paper in each paper ejection tray; and a control unit to control the display of the setting screen, wherein the control unit simultaneously displays the detected mounting amount of each paper ejection tray on one setting screen, the control unit calculates an anticipated mounting amount of the paper to be mounted by executing the reserved job and displays the calculated anticipated mounting amount on the display unit along with the present mounting amount of each paper ejection tray, and the control unit expresses the present mounting amount and the anticipated mounting amount by an image in which the paper is mounted on each paper election tray.

2. The image forming apparatus of claim 1, further comprising:

an image reading unit to read a document of the reserved job, wherein the control unit calculates the anticipated mounting amount based on the number of sheets of the document read by the image reading unit.

3. The image forming apparatus of claim 1, further comprising:

an operation unit, wherein the control unit calculates the anticipated mounting amount based on the number of sheets of the document when the number of sheets the document of the reserved job is input via the operation unit.

4. The image forming apparatus of claim 1, wherein the control unit expresses the present mounting amount or the anticipated mounting amount in a relative value with respect to maximum mounting amount of each paper ejection tray.

5. The image forming apparatus of claim 1, wherein the control unit displays the anticipated mounting amount in a display mode which is different from the present mounting amount.

6. The image forming apparatus of claim 5, wherein when there are a plurality of reserved jobs, the control unit displays the anticipated mounting amount of each reserved job in different display modes.

7. The image forming apparatus of claim 1, further comprising:

an operation unit, wherein when one paper ejection tray is selected among the plurality of paper ejection trays via the operation unit, the control unit determines whether a total mounting amount of the present mounting amount and the anticipated mounting amount of the selected paper ejection tray exceeds maximum mounting amount of the paper ejection tray or not, and the control unit displays a message indicating that the total mounting amount exceeds the maximum mounting amount on the display unit when the total mounting amount exceeds the maximum mounting amount.

8. The image forming apparatus of claim 7, wherein the control unit displays a message indicating that the total mounting amount exceeds the maximum mounting amount of the paper ejection tray.

9. The image forming apparatus of claim 7, wherein the control unit displays an image indicating that the total mounting amount exceeds the maximum mounting amount of the paper ejection tray.

10. The image forming apparatus of claim 7, wherein the control unit continues to display the message indicating that the total mounting amount exceeds the maximum mounting amount until the paper ejection tray is changed to another paper ejection tray via the operation unit.

11. The image forming apparatus of claim 1, wherein when the present mounting amount or the anticipated mounting amount is changed, the control unit updates and displays the present mounting amount or the anticipated mounting amount on the setting screen according to the changed present mounting amount or the changed anticipated mounting amount.

* * * * *